United States Patent [19]

Harper, Jr. et al.

[11] Patent Number: 4,765,796

[45] Date of Patent: Aug. 23, 1988

[54] PROCESS FOR FLAMEPROOFING CELLULOSIC FIBERS PRIOR TO DYEING

[75] Inventors: Robert J. Harper, Jr., Metairie; John V. Beninate, New Orleans, both of La.

[73] Assignee: The United States of America as represented by the Secretary of Agriculture, Washington, D.C.

[21] Appl. No.: 75,169

[22] Filed: Jul. 20, 1987

[51] Int. Cl.[1] ..... D06M 9/00; D06P 5/00

[52] U.S. Cl. ..... 8/115.7; 8/115.56; 8/115.57; 8/115.61; 8/115.64

[58] Field of Search ..... 8/115.7

[56] References Cited

U.S. PATENT DOCUMENTS

| | | | |
|---|---|---|---|
| 3,236,676 | 2/1966 | Coates | 117/62.2 |
| 3,784,356 | 1/1974 | Wagner | 8/196 |
| 4,078,101 | 3/1978 | Cole | 427/341 |
| 4,198,316 | 4/1980 | Nahta | 252/354 |

*Primary Examiner*—John F. Niebling
*Assistant Examiner*—Isabelle Rodriquez
*Attorney, Agent, or Firm*—M. Howard Silverstein

[57] ABSTRACT

Cellulosic fabric is dyed by affixing a hydroxymethyl phosphonium-nitrogen based polymer to the fabric and thereafter dyeing it with a cotton dye having anionic groups, in an acidic or neutral environment. In addition, a new method of affixing the polymer to the fabric is provided comprising contacting the fabric with a solution of urea and a precondensate of urea and tetrakis hydroxymethyl phosphonium salt.

20 Claims, No Drawings

PROCESS FOR FLAMEPROOFING CELLULOSIC FIBERS PRIOR TO DYEING

FIELD

This invention relates to dyeing flame-retardant cellulosic fabrics.

PRIOR ART

It is known in the art that hydroxymethyl phosphonium-nitrogen based polymers affixed to cellulosic fabrics provide flame retardancy. These fabrics usually are dyed before being finished with the polymer. However, such treated fabrics exhibit poor lightfastness characteristics and frequently undergo substantial shade changes during flame-retardant finishing. These shade changes make color matching difficult for garment production and severely restrict the types of cotton dyes that can be used on fabrics which are to be made flame-retardant by any of three known processes, namely: (1) tetrakis (hydroxymethyl) phosphonium hydroxide-ammonia (THPOH-$NH_3$), U.S. Pat. No. 3,607,356; (2) precondensate-ammonia process, U.S. Pat. No. 3,096,201; and (3) tetrakis (hydroxymethyl) phosphonium chloride (THPC)-urea process, Donaldson et al, J. Coated Fabrics, 3: 250–256, April 1974.

British Pat. No. 1,458,078 teaches that fabric treated with THPOH-$NH_3$ can be dyed with disperse or acid dyes. However, it should be noted that the THPOH-$NH_3$ polymer systems in this patent were not oxidized.

Trask et al, Textile Chemist and Colorists, "Acid Metallized Dyeing of THPOH-$NH_3$ Polymer in Oxidized Fabrics," Vol. 8, no. 7, pp 105–107, July 1976, reported that nonoxidized THPOH-$NH_3$ polymer systems show reduced affinity for acid dyes and also that oxidized fabric can have affinity for acid metallized dyes.

SUMMARY

In the present invention, a hydroxymethyl phosphonium-nitrogen based polymer is affixed to cellulosic fabric for the purpose of imparting flame retardancy and cationic characteristics to the fabric. Thereafter, the fabric is dyed with a cotton dye having anionic groups, in an acidic or neutral environment. As used in the specification and claims, the phrase "cotton dye" means a dye such as a direct or reactive dye, that is used by the textile industry to dye cotton fabrics. It does not include such dyes as disperse, acid or acid metallized dyes because such dyes are designed to dye fabrics made with synthetic or proteinaceous fibers such as disperse for polyester fabrics and acid or acid metallized dyes for nylon or woolen fabrics.

The phrase "cellulosic fabric", as used in the specification and claims, includes 100% cotton and 100% rayon fabrics. In addition to 100% cellulosic fabrics, the invention can be applied to blends such as cotton-wool, cotton-polyester, rayon-polyester to render the cellulosic component of these fabrics flame retardant and cationic.

Another aspect of the present invention pertains to a new method of affixing a hydroxymethyl phosphonium-nitrogen based polymer to cellulosic fabric. Broadly, this process comprises contacting a cellulosic fabric with an aqueous solution of urea and a precondensate of tetrakis hydroxymethylphosphonium salt and urea, wherein the solution has a pH of 5.0–7.0 and preferably includes buffering agent to neutralize any acids subsequently formed during heat curing, and thereafter heat curing the fabric to render it cationic and flame-retardant.

Therefore, it is an object of the present invention to dye fabrics with cotton dyes having anionic groups, which fabrics previously have been rendered flame retardant with hydroxymethyl phosphonium-nitrogen based polymers.

Another object is to perform the dyeing step under acidic up to neutral conditions, thereby eliminating the need for added salts such as carbonates, other bases and standard salts normally used in cellulosic fabric dyeing procedures.

Another object is to provide a new method of applying such flame retardant polymers to cellulosic fabrics, wherein the subsequently dyed fabric shows improved lightfastness in comparison to the application of the flame retardant in the prior art manner.

Another object is to provide a heat cure method of applying a flame retardant cationic polymer, which method reduces fabric strength loss, eliminates fabric discoloration problems, and increases total add-on of flame retardant polymer.

Still another object of the present invention is to provide a method of applying the flame retardant polymer in question which reduces the odor problems found in the prior art methods of applying the polymer.

Yet a further object is to provide a method of applying the polymer in which the cationic character of the resultant fabric is greater than that achieved in the prior art.

A further object is to provide a method of applying the polymer which eliminates the need for gaseous ammonia in polymer fixation.

Another object is to provide a method of applying the polymer which can be performed by a simple pad, dry, cure process.

A further object is to provide a method of applying the polymer that is faster, less complicated, less expensive than the prior art gaseous ammonia curing process.

A further object is to provide a method of applying the polymer that does not require special equipment to contain noxious ammonia fumes.

A further object is to eliminate ammonia amine linkage in the flame retardant polymer thereby leading to greater cationic dyeability character in the finished flame retardant product.

DETAILED DESCRIPTION

In the practice of the present invention, the flame retardant hydroxymethyl phosphonium-nitrogen based polymer may be applied to the cellulosic fabric in the prior art manner. For example, one may employ the THPOH-ammonia process, the precondensate-ammonia process or the THPC-urea process. Frequently, these prior art methods include the step of oxidizing the deposited polymer for the purpose of stabilization.

Alternatively, the flame retardant polymer may be applied by the new method of the present invention. In the typical practice thereof, an aqueous solution is prepared having about 4–8% urea and 20–40% precondensate of tetrakis (hydroxymethyl) phosphonium salt (THP) and urea. The precondensate contains a ratio of THP-to-urea ranging from about 1.2:1 to 2.5:1, preferably about 2:1. Methods for forming precondensates are known in the prior art, as taught, for example, in U.S.

Pat. No. 2,983,623. A wetting agent such as alkylarylethoxylate or alkylethoxylate preferably is present in an amount of about 0.1%. The mixture is neutralized to pH 5.0–7.0 with an alkaline solution. Thereafter, a buffering salt preferably is added to the mixture for the purpose of neutralizing acids formed during the subsequent heat curing step. Typical buffering salts may be disodium monoacid phosphate or sodium, potassium or magnesium acetate, and ordinarily are present in an amount of about 3–8% of the solution. After addition of the buffering salt, the pH again is adjusted to 5.0–7.0, if necessary. The solution then is applied to the cellulosic fabric in the prior art manner, for example, by padding, afterwhich the treated fabric is dried to remove water and heat cured to fix the polymer thereon. Following fixation, the polymer may be oxidized in the prior art manner, for example, with hydrogen peroxide solution, for the purpose of stabilization.

The presence of buffering salts is preferred because, in the absence of such salts, the heat-cure of the precondensate and urea develops strong acidity which leads to fabric discoloration, loss of fabric strength and reduced add-on.

The dyeing step of the present invention can be performed with any dyestuff that has an anionic component. Two noteworthy classes of cotton dyes for this purpose are reactive and direct dyes, although other classes with anionic components would be effective as well. The function of the anionic component is to form a salt bond with the cationic component in the polymer.

Prior art procedures for contacting the fabric with dye, including contact times and temperatures, are employed in the practice of the present invention. However, in recognition of the cationic character of the fire retardant polymer, the nature of the dye and the pH environment are different. More specifically, normal cotton dyeing with reactive dyes is performed using a basic catalyst to promote a reaction of cellulose alkoxide with the dye via a nucleophilic displacement, and a large amount of salt is used to promote dye absorption. Similarly, dyeing with direct dyes in the prior art is performed under neutral or alkaline conditions with a large amount of salt present to agglomerate the dye. On the other hand, in the practice of the present invention, dyeing is based upon attraction of the cationic component of the polymer for the anionic group of the direct or reactive dye to form a dye salt agglomerate. In order to promote this interaction, dyeing is performed in the absence of salts and in an acid to neutral environment because additional anions from salts or alkali would only compete with the anionic component of the dye during fixation. Therefore, in the present invention, dyeing is carried out in an acidic to neutral environment at a pH of 3–7, more preferably at a pH of 4.0–5.0.

In a typical pilot scale dyeing procedure, in order to promote dye fixation, the fabrics to be dyed may be immersed for about 5–15 minutes in a bath of deionized water at an acidic or neutral pH. The fabric then is removed from the bath, and the above described dyes are added to the bath at the appropriate pH. The fabric again is immersed in the bath, which then is heated to about 40°–50° C. while stirring, for about 30–45 minutes. Thereafter the bath temperature is raised to about 60°–100° C. for about 15–45 minutes with continuous stirring. The dye solution then is separated from the fabric by, for example, decanting, afterwhich the fabric is washed 3–4 times in deionized water, to remove excess dye. Subsequently, the fabric is reheated in a slightly acidic bath at about 75°–80° C. for about 15–20 minutes to further remove excess dye. Finally the fabric is washed and dried (laundered).

As an optional step in the practice of the present invention, the fabric may be mercerized prior to flame retardant treatment, because mercerized fabrics achieve greater color intensity than unmercerized fabrics. Other pretreatments which may be employed include desizing, scouring and bleaching.

The following examples are laboratory tests of the present invention. In these tests, K/S values, which pertain to the Kubelka-Monk equation, are directly related to the color intensity of the fabric. The higher the K/S value, the greater the color depth and hence the greater the dye absorption in dyeing. The dyeing procedure employed in these tests, hereinafter referred to as Dye Procedure A, was as follows: Fabric was immersed for 15 minutes in a bath of deionized water (30:1, water:weight of fabric) in which the pH was adjusted to about 4.0–4.5 with acetic acid. The samples were removed and the dye was added. The bath pH again was adjusted to about 4.0–4.5. Samples were added back to the bath which was heated to 50° C. while stirring at this temperature for about 30 minutes. Bath temperature was raised to about 80° C. for about 30 minutes with continuous stirring. Then, the dye solution was decanted. Samples were afterwashed 3–4 times in deionized water to remove excess dye; heated in a slightly acidic bath at about 75° C.–80° C. for about 15 minutes to remove loosely bound dye; and the samples then were washed and dried (laundered).

EXAMPLES 1–4

Preparation of Flame-Retardant Fabrics and the Dyeing of Derived Fabrics With Reactive Yellow 27 Using Dye Procedure A Samples of mercerized and non-mercerized cotton twills were finished using the THPOH-$NH_3$ process (U.S. Pat. No. 3,607,356). A solution (Pad Bath A) was prepared containing 30% tetrakis(hydroxymethyl) phosphonium sulfate (THPS) and the remainder water, and then neutralized to pH 7.5 with 50% sodium hydroxide solution. This formulation (Pad Bath A) was used to pad samples of mercerized and non-mercerized cotton twill. The samples were dried at 85° C. for 5 minutes, then cured with ammonia gas at room temperature for 4 minutes in a chamber. The resultant fabric was oxidized with a solution containing 1% $H_2O_2$, then washed and dried.

Similarly, mercerized and non-mercerized cotton twill were finished with a precondensate-$NH_3$ finish. In this case, a pad bath (Bath B) was prepared containing 30% precondensate (formed by reaction of THPC and urea), and 1% sodium acetate and the remainder $H_2O$. Then mercerized and non-mercerized cotton twill samples were padded with Bath B. The padded samples were then dried, ammoniated with gaseous $NH_3$, oxidized and laundered as was done with the THPOH-$NH_3$ finish described supra.

A third pad bath (Bath C) was prepared to treat fabric with a THPC-urea finish. In this instance, pad bath C was prepared containing 26.6% THPC, 8.4% urea, 4% $Na_2HPO_4$ and the remainder water. The solution was neutralized with 50% caustic to a pH of 7.0. Samples of mercerized and non-mercerized cotton twill were then padded with Bath C, dried for 5 minutes at 85° C., cured for 3 minutes at 160° C., oxidized, and then washed and dried as described supra.

Finally, a fourth bath (Bath D) was prepared for the application of a precondensate-urea FR finish to cotton. Bath D consisted of 30% precondensate, 6% urea, and 0.1% wetting agent with the remainder water. PH of Bath D was adjusted to 5.5 with strong caustic (50% NaOH), then 5% $Na_2HPO_4$ was added to (Bath D). Final pH was 5.8. Samples of mercerized and non-mercerized cotton twill were then padded with Bath D, dried for 7 minutes at 60° C., cured for 4 minutes at 160° C., oxidized, and then washed and dried as described supra.

A portion of each of the above described fabric samples and untreated cotton controls were dyed with 4% Reactive Yellow 27 (based on weight of fabric being dyed). K/S values for these fabrics were obtained and reported in Tables I and II. All of the flame-retardant fabrics show fixation of the dyestuff with the greatest fixation occuring in the case of the fabrics finished with precondensate or urea or both. By contrast, the untreated cotton controls were undyed. The substantial fixation of dyestuff provides a ready demonstration of the cationic character of polymer formed on the fabric, the feasibility of dyeing subsequent to flame retardant finishing, and the ability of the fabrics to be dyed with anionic dyestuffs.

TABLE I

K/S VALUES OF FLAME-RETARDANT MERCERIZED FABRICS DYED VIA DYE PROCEDURE A

| Fabric | Reactive Yellow 27 | Reactive Blue 29 | Reactive Red 40 | Direct Blue 1 | Reactive Blue 3 | Reactive Red 2 |
|---|---|---|---|---|---|---|
| THPOH-$NH_3$ | 7.3 | 1.8 | 4.5 | 12.2 | 13.7 | 19.8 |
| PRECON-$NH_3$ | 12.2 | 7.6 | 7.3 | 14.6 | 14.6 | 18.2 |
| THPC-UREA | 12.9 | 12.5 | 4.1 | 14.6 | 19.0 | 11.2 |
| PRECON-UREA | 12.5 | 13.7 | 15.7 | 18.2 | 10.9 | 22.8 |
| MERCERIZED CONTROL | 0.1 | 0.0 | 0.0 | 1.6 | 0.7 | 0.2 |

TABLE II

K/S VALUES OF FLAME-RETARDANT NON-MERCERIZED FABRICS DYED VIA PROCEDURE A

| Fabric | Reactive Yellow 27 | Reactive Blue 29 | Reactive Red 40 | Direct Blue 1 | Reactive Blue 3 | Reactive Red 2 |
|---|---|---|---|---|---|---|
| THPOH-$NH_3$ | 5.8 | 1.9 | 3.0 | 8.6 | 7.5 | 12.9 |
| PRECON-$NH_3$ | 7.0 | 4.1 | 5.2 | 9.9 | 10.4 | 11.2 |
| THPC-UREA | 10.4 | 7.8 | 3.6 | 11.8 | 16.9 | 10.4 |
| PRECON-UREA | 10.9 | 5.5 | 10.9 | 19.0 | 21.7 | 15.7 |
| NON-MERCERIZED CONTROL | 0.1 | 0.0 | 0.1 | 1.5 | 0.7 | 0.3 |

EXAMPLE 5

Dyeing of Flame-Retardant Fabrics With Reactive Blue 29 Using Dye Procedure A Samples of the various undyed flame-retardant fabrics and untreated cotton controls from Examples 1–4 were dyed with Reactive Blue 29 using Dye Procedure A. The Reflectance Values of these fabrics were measured and K/S values determined. As these K/S values in Tables I and II show all flame-retardant fabrics were cationic. Fabrics with finishes other than THPOH-$NH_3$ showed greater dye uptake in this case.

EXAMPLE 6

Dyeing of Flame-Retardant Fabrics With Reactive Red 40 Using Dye Procedure A Samples of the various undyed flame-retardant fabrics and untreated cotton controls from Examples 1–4 were dyed with Reactive Red 40 using Dye Procedure A. Reflectance values of these fabrics were measured and K/S values determined. The K/S values in Tables I and II demonstrate that all the flame-retardants are cationic. Furthermore, the K/S values of the fabrics finished with precondensate-urea were higher than others, indicative of greater cationic character. These results show that FR fabrics can be dyed subsequent to FR finishing if the cationic character of the FR substrate is recognized and if an appropriate anionic dye is utilized.

EXAMPLE 7

Dyeing of Flame-Retardant Fabrics With Direct Blue 1 Using Dye Procedure A

Samples of various undyed flame-retardant fabrics and untreated cotton from controls from Examples 1–4 were dyed with Direct Blue 1 using Dye Procedure A. The reflectance values of these fabrics were measured and K/S values determined. As the K/S values demonstrate in Tables I and II, supra, all FR fabrics had substantial cationic character and were deeply dyed. By contrast, the untreated cotton controls were only lightly dyed. Furthermore, as the lightfastness data given in Table III infra demonstrate, heat cure finishes particularly, the precondensate-urea finish, give superior lightfastness over other finishes, particularly those using $NH_3$ gas in the finish.

TABLE III

LIGHTFASTNESS OF FR FABRICS DYED WITH DIRECT BLUE 1

| Fabric | | Colorfastness to Light[1] Carbon ARC - Hours | | | |
|---|---|---|---|---|---|
| Mercerized | Treatment | 10 | 20 | 30 | 40 |
| Yes | THPOH-$NH_3$ | 1.0 | — | — | — |
| Yes | PRECON-$NH_3$ | 2.0 | — | — | — |
| Yes | THPC-UREA | 4.0 | 3.0 | — | — |

TABLE III-continued

LIGHTFASTNESS OF FR FABRICS DYED WITH DIRECT BLUE 1

| Fabric | | Colorfastness to Light[1] Carbon ARC - Hours | | | |
|---|---|---|---|---|---|
| Mercerized | Treatment | 10 | 20 | 30 | 40 |
| Yes | PRECON-UREA | 4.5 | 4.0 | 3.5 | — |
| No | THPOH-$NH_3$ | 1.0 | — | — | — |
| No | PRECON-$NH_3$ | 2.0 | — | — | — |
| No | THPC-UREA | 4.0 | 3.0 | — | — |
| No | PRECON-UREA | 4.5 | 4.5 | 4.0 | 3.0 |

[1]Colorfastness testing was discontinued after rating decreased to less than 4.0.

EXAMPLE 8

Dyeing of Flame-Retardant Fabrics With Reactive Blue 3 Using Dye Procedure A Samples of the various undyed flame-retardant fabrics and untreated cotton controls from Examples 1–4 were dyed with Reactive Blue 3 using dye procedure A. The reflectance values of these fabrics were measured and K/S values determined. As shown by the K/S values in Tables I and II, all FR fabrics had substantial cationic character and were deeply dyed. By contrast, the untreated cotton controls were only lightly tinted. These data show that FR fabrics can be dyed subsequent to the FR treatment using a dye procedure that recognizes said fabrics cationic character.

EXAMPLE 9

Dyeing of Flame-Retardant Fabrics With Reactive Red 2 Using Dye Procedure A

Samples of the various undyed flame-retardant fabrics and untreated cotton controls from Examples 1–4 were dyed with Reactive Red 2 using dye procedure A. The reflectance values of these fabrics were measured and K/S values determined. As the K/S values demonstrate in Tables I and II, all of the FR fabrics had substantial cationic character and were deeply dyed. By contrast, the untreated cotton controls were only lightly dyed. These data show that FR fabrics can be dyed subsequent to the FR treatment using a dye procedure that recognizes said fabrics cationic character.

EXAMPLE 10

Dyeing of Flame-Retardant Fabrics With Reactive Orange 4 Using Dye Procedure A Samples of various undyed flame-retardant fabrics and untreated cotton controls from Examples 1–4 were dyed with Reactive Orange 4 using dye procedure A. The reflectance values of these fabrics were measured and K/S values determined. As the K/S values demonstrate in Tables IV and V infra, all FR fabrics had substantive cationic character and were highly dyed. It might be noted that the more deeply dyed fabrics were heat cured fabrics that used urea in the finish. By contrast, the untreated cotton controls were only lightly dyed. These data show that FR fabrics can be dyed subsequent to the FR treatment using an anionic dye and a dye procedure that recognizes said fabrics cationic character. Moreover, the lightfastness of fabric treated with precondensate-urea was superior to that of other flame-retardant fabrics in this series as can be seen in Table VI infra.

TABLE IV

K/S VALUES OF FLAME-RETARDANT FABRICS (MERCERIZED) DYED WITH PROCEDURE A

| FABRIC | REACTIVE ORANGE 4 | DIRECT BLUE 86 | DIRECT RED 26 | ACID GREEN 25 | DIRECT GREEN 28 |
|---|---|---|---|---|---|
| THPOH-$NH_3$ | 10.4 | 8.1 | 10.9 | 1.7 | 1.5 |
| PRECON-$NH_3$ | 14.6 | 11.8 | 12.9 | 7.2 | 2.5 |
| THPC-UREA | 20.7 | 16.3 | 15.7 | 21.7 | 4.7 |
| PRECON-UREA | 18.2 | 21.7 | 14.2 | 11.2 | 2.6 |
| MERCERIZED CONTROL | 0.1 | 0.8 | 3.2 | 0.3 | 0.2 |

TABLE V

K/S VALUES OF FLAME-RETARDANT FABRICS (NON-MERCERIZED) DYED WITH PROCEDURE

| FABRIC | REACTIVE ORANGE 4 | DIRECT BLUE 86 | DIRECT RED 26 | ACID GREEN 25 | DIRECT GREEN 28 |
|---|---|---|---|---|---|
| THPOH-$NH_3$ | 9.4 | 4.9 | 6.6 | 1.8 | 1.3 |
| PRECON-$NH_3$ | 11.6 | 6.2 | 8.3 | 4.2 | 1.5 |
| THPC-UREA | 17.5 | 13.3 | 12.2 | 14.2 | 4.5 |
| PRECON-UREA | 14.2 | 9.9 | 9.7 | 7.4 | 2.3 |
| NON-MERCERIZED CONTROL | 0.2 | 0.9 | 2.0 | 0.3 | 0.1 |

TABLE VI

LIGHTFASTNESS OF FR FABRICS DYED WITH REACTIVE ORANGE 4

| Fabric | | Colorfastness to Light[1] Carbon ARC - Hours | | |
|---|---|---|---|---|
| Mercerized | Treatment | 10 | 20 | 30 |
| Yes | THPOH-$NH_3$ | 1.0 | — | — |
| Yes | PRECON-$NH_3$ | 1.0 | — | — |
| Yes | THPC-UREA | 1.0 | — | — |
| Yes | PRECON-UREA | 5.0 | 4.0 | 2.0 |
| No | THPOH-$NH_3$ | 1.0 | — | — |
| No | PRECON-$NH_3$ | 1.0 | — | — |
| No | THPC-UREA | 1.0 | — | — |
| No | PRECON-UREA | 4.5 | 3.5 | — |

[1]Colorfastness testing was discontinued after rating decreased to less than 4.0.

EXAMPLE 11

Dyeing of Flame-Retardant Fabrics With Direct Blue 86 Using Dye Procedure A

Samples of various undyed flame-retardant fabrics and untreated cotton controls from Examples 1–4 were dyed with Direct Blue 86 using Dye Procedure A. The reflectance values of these fabrics were measured and K/S values determined. As the K/S values demonstrate in Tables IV and V supra, all FR fabrics had substantial cationic character and were highly dyed. It should be noted that the more deeply dyed were the heat cured fabrics that used urea in the finish. By contrast, the untreated cotton controls were only lightly dyed. These data show that FR fabrics can be dyed subsequent to the FR treatment using an anionic dye and a dye procedure that recognizes said fabrics cationic character.

EXAMPLE 12

Dyeing of Flame-Retardant Fabrics With Direct Red 26 Using Dye Procedure A

Samples of various undyed flame-retardant fabrics and untreated cotton controls from Examples 1–4 were dyed with Direct Red 26 using Dye Procedure A. The reflectance values of these fabrics were measured and the K/S values determined. The K/S values as reported in Tables IV and V supra demonstrate, all FR fabrics had substantial cationic character and were highly dyed. The more deeply dyed were heat cured fabrics that used urea in the finish. By contrast the untreated cotton controls were dyed to a lesser extent. These data show that FR fabrics can be dyed subsequent to the FR treatment by use of an anionic dye that recognizes said fabrics cationic character.

EXAMPLE 13

Dyeing of Flame-Retardant Fabrics With Acid Green 25 Using Dye Procedure A

Samples of various undyed flame-retardant fabrics and untreated cotton controls from Examples 1–4 were dyed with Acid Green 25 using Dye Procedure A. The reflectance values of these fabrics were measured and the K/S values determined. The K/S values as reported in Tables IV and V supra demonstrate, all FR fabrics had cationic character and were dyed. However, the heat cure finishes were much more deeply dyed. By contrast, the untreated cotton controls were only lightly dyed. The lightfastness data given in Table VII infra, illustrates the superior lightfastness of the heat cure fabrics, particularly the precondensate-urea finish.

TABLE VII

LIGHTFASTNESS OF FR FABRICS DYED WITH ACID GREEN 25

| Fabrics | | Colorfastness to Light[1] Carbon ARC - Hours | | | | |
|---|---|---|---|---|---|---|
| Mercerized | Treatment | 10 | 20 | 30 | 40 | 50 |
| Yes | THPOH-$NH_3$ | 4.0 | 3.0 | — | — | — |
| Yes | PRECON-$NH_3$ | 4.0 | 3.0 | — | — | — |
| Yes | THPC-UREA | 5.0 | 4.0 | 3.5 | — | — |
| Yes | PRECON-UREA | 4.5 | 4.5 | 4.5 | 4.0 | 3.5 |
| No | THPOH-$NH_3$ | 3.5 | — | — | — | — |
| No | PRECON-$NH_3$ | 4.0 | 3.0 | — | — | — |
| No | THPC-UREA | 5.0 | 4.0 | 3.5 | — | — |
| No | PRECON-UREA | 4.5 | 4.5 | 4.5 | 4.0 | 3.5 |

[1]Colorfastness testing was discontinued after rating decreased to less than 4.0.

EXAMPLE 14

Dyeing of Flame-Retardant Fabrics With Direct Green 28 Using Dye Procedure A Samples of various undyed flame-retardant fabrics and untreated cotton controls from Examples 1–4 were dyed with Direct Green 28 using Dye Procedure A. The reflectance values of these fabrics were measured and the K/S values determined. As the K/S values in Tables IV and V supra, demonstrate, all the FR fabrics had cationic character. Those samples finished with the heat cure finishes were more deeply dyed. By contrast the untreated cotton controls were only lightly dyed. The lightfastness data given in Table VIII supra, illustrates the improved lightfastness of the heat cure fabrics.

TABLE VIII

LIGHTFASTNESS OF FR FABRICS DYED WITH DIRECT GREEN 28

| Fabrics | | Colorfastness to Light[1] Carbon ARC - Hours | | | | |
|---|---|---|---|---|---|---|
| Mercerized | Treatment | 10 | 20 | 30 | 40 | 50 |
| Yes | THPOH-$NH_3$ | 3.0 | — | — | — | — |
| Yes | PRECON-$NH_3$ | 4.0 | 3.0 | — | — | — |
| Yes | THPC-UREA | 4.0 | 4.0 | 4.0 | 4.0 | 3.0 |
| Yes | PRECON-UREA | 4.0 | 4.0 | 3.5 | — | — |
| No | THPOH-$NH_3$ | 2.5 | — | — | — | — |
| No | PRECON-$NH_3$ | 3.0 | — | — | — | — |
| No | THPC-UREA | 4.0 | 4.0 | 4.0 | 3.5 | — |
| No | PRECON-UREA | 4.5 | 4.0 | 3.5 | — | — |

[1]Colorfastness testing was discontinued after rating decreased to less than 4.0.

EXAMPLE 15

Durability of Flame-Retardant Treatment With the Precondensate-Urea Heat Cure System Samples of cotton twill fabric treated with precondensate and urea as in Examples 1–4, (padded with Bath D, then dried, cured, oxidized, washed and dried) were laundered one time. Add-on of the finish was 14.0% for the mercerized twill and 14.4% for the non-mercerized twill. A portion of the fabric was then subjected to the vertical flame test according to Test Method 5903 of Federal Test Method Standard 191 A (5) test procedure. The char-length of the treated mercerized fabric was 3.5 in. The char-length of the treated non-mercerized fabric was 3.0 in. Additional quantities of these fabrics were laundered 25 times. The char-lengths of these fabrics after 25 launderings was 3.6 in. for the mercerized fabric and 3.2 in. for the non-mercerized fabric. In the vertical flame test, a char length of less than 5.0 in. means that the sample passed the test and the fabric is flame-retardant. These results indicate that this treatment consisting of precondensate and urea with a salt additive and a heat-cure leads to a durable flame-retardant fabric.

EXAMPLE 16

Treatment of a Cotton Doubleknit With the Precondensate-Urea System

A cotton doubleknit was padded with pad bath D (Examples 1–4), then dried for 7 minutes at 60° C., and cured for 4 minutes at 160° C. The fabric was then oxidized in 1% $H_2O_2$ in a washing machine and laundered. The add-on of the finish on the knit was 24.7%. Then, the fabric was laundered (washed and tumble dried). The char-length of this fabric in the vertical flame test was 3.4 in. Additional material for this treated fabric was laundered 25 times. The vertical flame test measured 2.5 in. On the basis of these vertical flame tests, it can be seen that cellulosic fabric can be made durably flame-retardant using a heat cure of a precondensate [derived from tetrakis(hydroxymethyl) phosphonium salt and urea] and added urea provided the proper balance of salt buffers and pH control are incorporated in the finishing formulation.

EXAMPLES 17–20

Preparation of Flame-Retardant Blend Fabrics and the Dyeing of Derived Fabrics With Reactive Yellow 27 Using Dye Procedure A Samples of a 60% cotton-40% wool fabric, an 85% cotton-15% nylon twill and an 80% cotton-20% polyester twill were finished using the THPOH-$NH_3$ process. A solution (Pad Bath A) was prepared containing 30% tetrakis (hydroxymethyl)phosphonium sulfate (THPS) and the remainder water; and then neutralized to Ph 7.5 with 50% sodium hydroxide solution. This formulation (Pad Bath A) was used to pad samples of mercerized and non-mercerized cotton twill. The fabric samples were dried at 85° C. for 5 minutes, then cured with ammonia gas at room temperature for 4 minutes in a chamber. The resultant fabric was oxidized with a solution containing 1% $H_2O_2$, then washed and dried.

Similarly, a 60% cotton-40% wool fabric, a 85% cotton-15% nylon twill and a 80% cotton-20% polyester twill were finished with a precondensate $NH_3$ finish. In this case, a pad bath (Bath B) was prepared containing 30% precondensate (formed by reaction of tetrakis (hydroxymethyl)phosphonium chloride and urea), and 1% sodium acetate and the remainder $H_2O$. Then mercerized and non-mercerized cotton twill samples were padded with Bath B. The padded samples were then dried, ammoniated with gaseous $NH_3$, oxdized and laundered as was done with the THPOH-$NH_3$ finish as described supra.

A third pad bath (Bath C) was prepared to treat the blend fabrics with a THPC-urea finish. In this instance, pad bath C was prepared containing 26.6% THPC, 8.4% urea, 4% $Na_2HPO_4$ and the remainder water. The solution was neutralized with 50% caustic to a pH of 7.0. Samples of untreated blend fabrics were then padded with Bath C, dried for 5 minutes at 85° C., cured for 3 minutes at 160° C., oxidized, washed and dried as described supra.

Finally, a fourth bath (Bath D) was prepared for the application of a the precondensate-urea FR finish to cotton blend fabrics. This bath consisted of 30% precondensate, 6% urea, and 0.1% wetting agent with the remainder water. Bath pH of Bath D was adjusted to 5.5 with strong caustic (50% sodium hydroxide), then 5% $Na_2HPO_4$ was added to Bath D. Bath pH was 5.8. Samples of untreated blend fabrics were then padded with Bath D, dried for 7 minutes at 60° C., cured for 4 minutes at 160° C., oxidized, then washed and dried as described supra.

A portion of each of the above described blend fabric samples and untreated cotton blend controls were dyed with 4% Reactive Yellow 27 (based on weight of fabric being dyed) using (Dye Procedure A) described supra. The reflectance values of these fabrics were measured and the K/S values of these fabrics were determined.

As the K/S values for these fabrics indicate (Table IX), all of the flame-retardant treated fabrics show much greater fixation of the dyestuff than the untreated cotton-blend controls. The untreated cotton-blend controls were undyed. The substantial fixation of dyestuff provides a ready demonstration of the cationic character of polymer formed on the fabric, the feasibility of dyeing subsequent to FR finishing, and the ability of said fabrics to be dyed with anionic dyestuffs.

EXAMPLE 21

Dyeing of Flame-Retardant Fabrics With Direct Blue 1 Using Dye Procedure A

Samples of various undyed flame-retardant fabrics and untreated cotton blend controls from Examples 17–20 were dyed with Direct Blue 1 using Dye Procedure A. The reflectance values of these fabrics were measured and K/S values determined. As the K/S values demonstrate in Table IX, all FR fabrics had substantial cationic character and were deeply dyed. By contrast, and untreated blend controls were only lightly dyed. The substantial fixation of dyestuff provides a ready demonstration of the cationic character of polymer formed on the fabric, the feasibility of dyeing subsequent to FR finishing, and the ability of said fabrics to be dyed with anionic dyestuffs.

TABLE IX

KS VALUES OF FLAME-RETARDANT TREATED BLEND FABRICS DYED VIA DYE PROCEDURE A

| | KS VALUES | | | | | |
|---|---|---|---|---|---|---|
| | REACTIVE YELLOW 27 | | | DIRECT BLUE 1 | | |
| TREATMENT | COTTON-[1] WOOL | COTTON-[2] NYLON | COTTON-[3] POLYESTER | COTTON-WOOL | COTTON-NYLON | COTTON-POLYESTER |
| THPOH-$NH_3$ | 9.2 | 11.2 | 10.1 | 18.2 | 16.9 | 16.3 |
| PRECON-$NH_3$ | 13.3 | 10.9 | 10.7 | 18.2 | 15.1 | 14.2 |
| THPC-UREA | 8.1 | 9.4 | 7.8 | 12.9 | 12.9 | 10.9 |
| PRECON-UREA | 6.6 | 4.5 | 5.4 | 11.8 | 6.7 | 8.0 |
| UNTREATED CONTROLS | 2.0 | 0.6 | 0.2 | 4.3 | 2.1 | 1.7 |

[1]Cotton-wool blend was 60% cotton-40% wool.
[2]Cotton-nylon blend was 85% cotton-15% nylon.
[3]Cotton-polyester blend was 80% cotton-20% polyester.

EXAMPLE 22

Performance of Flame-Retardant Treatment With the Precondensate-Urea Heat Cure System Samples of blend fabrics treated with precondensate and urea as in Example 20, (padded with Bath D, then dried, cured, oxidized, washed and dried) were laundered one time. Add-on of the finish was 17.5% for the 60% cotton-40% wool blend, 13.2% for the 85% cotton-15% nylon twill, and 12.8% for the 80% cotton-20% polyester twill. A portion of the fabric was then subjected to the vertical flame test according to Test Method 5903 of Federal Test Method Standard 191 A (5) test procedure. The char-length for the 60% cotton-40% wool blend was 3.0. in., for the 85% cotton-15% nylon twill was 3.7 in., and for the 80% cotton-20% polyester twill was 3.8 in.

These results indicate that this treatment consisting of precondensate and urea with a salt additive and a heat-cure leads to launderable flame-retardant blend fabrics.

EXAMPLE 23

Application of Flame-Retardant Treatments Based on Precondensate-Urea Heat Cure System to Cotton Twills Samples of three cotton twills were treated with three versions of precondensate-urea heat cure treatment. A first pad bath (Bath E) was prepared the same as Bath D supra except that 5% sodium acetate was used in the formulation instead of 5% sodium $Na_2HPO_4$. The bath pH is 5.8. A second bath (Bath F) was prepared the same as Bath D except that after the addition of $Na_2HPO_4$, the bath pH was adjusted to 5.8 with caustic to make the pH the same as that of Bath E. Finally, a third bath (Bath G) consisted of 30% precondensate, 6% urea, and 0.1% wetting agent and the remainder water. Bath pH of Bath G was adjusted to 5.8 with strong caustic (50% sodium hydroxide).

Untreated samples of each of three cotton twills (A, B, and C) were padded with Baths E, F, and G, dried for 7 minutes at 60° C., cured for 4 minutes at 160° C., oxidized, then washed and dried as described supra.

The results of these experiments are given in Table X. Here, it can be seen that although the pad bath of all samples had equal pH values, those with a buffer (sodium acetate or $Na_2HPO_4$) showed higher add-ons and remained white whereas the fabrics finished with the unbuffered heat cure treatment had lower add-ons and turned brown on curing as in Table X. Browning on curing is an indication of fabric oxidation indicative of cellulosic degradation.

TABLE X

INFLUENCE OF PRESENCE OF BUFFER ON PERFORMANCE OF COTTON FABRICS WITH PRECONDENSATE-UREA HEAT-CURE FINISH

| FINISH | | | | | |
|---|---|---|---|---|---|
| % PRECONDENSATE | % UREA | % BUFFER | COTTON FABRIC | % ADD-ON | COLOR |
| 30 | 6 | 5% NaAc | A | 14.4 | WHITE |
| 30 | 6 | 5% $Na_2HPO_4$ | A | 13.2 | WHITE |
| 30 | 6 | NONE | A | 10.2 | BROWN |
| 30 | 6 | 5% NaAc | B | 14.2 | WHITE |
| 30 | 6 | 5% $Na_2HPO_4$ | B | 13.6 | WHITE |
| 30 | 6 | NONE | B | 10.0 | BROWN |
| 30 | 6 | 5% NaAc | C | 16.0 | WHITE |
| 30 | 6 | 5% $Na_2HPO_4$ | C | 15.2 | WHITE |
| 30 | 6 | NONE | C | 10.8 | BROWN |

We claim:

1. A process for producing a dyed fabric comprising
   a. affixing a hydroxymethyl phosphonium-nitrogen based polymer to cellulosic fabric for the purpose of imparting flame retardancy and cationic characteristics thereto; and
   b. thereafter dyeing said fabric, in an acidic or neutral environment, with a cotton dye having anionic groups.

2. The process of claim 1 wherein said polymer is affixed to said fabric by contacting said fabric with an aqueous solution of urea and a precondensate of urea and tetrakis hydroxymethyl phosphonium salt, wherein said solution has a pH of about 5.0 to 7.0 and includes buffering agent to neutralize acids formed during subsequent heat curing; and thereafter heat curing said fabric to render it cationic and flame retardant.

3. The process of claim 1 wherein said cellulosic fabric is a cotton blend or 100% cotton.

4. The process of claim 1 wherein said dye is a direct or reactive dye.

5. The process of claim 1 wherein said dyeing step is carried out at a pH of 3–7.

6. The process of claim 1 wherein said dyeing step is carried out at a pH of about 4.0–5.0.

7. The process of claim 2 wherein said dye is a direct or reactive dye.

8. The process of claim 2 wherein said solution comprises about 4–8% urea, and 20–40% precondensate, wherein said precondensate has a ratio range of tetrakis hydroxymethylphosponium salt-to-urea of about 1.2:1 to 2.5:1; wherein said buffering agent is added after said solution's pH is adjusted to about 5.0–7.0; and wherein said buffering agent is selected from the group consisting of sodium acetate, potassium acetate, magnesium acetate and disodium monoacid phosphate.

9. The process of claim 3 wherein said dye is a direct or reactive dye.

10. The process of claim 7 wherein said dyeing step is carried out at a pH of 3–7.

11. The process of claim 7 wherein said cellulosic fabric is a cotton blend or 100% cotton.

12. The process of claim 9 wherein said dyeing step is carried out a pH of 3–7.

13. The process of claim 10 wherein said pH is about 4.0–5.0.

14. The process of claim 11 wherein said dyeing step is carried out at a pH of 3–7.

15. The process of claim 12 wherein said pH is about 4.0–5.0.

16. The process of claim 14 wherein said pH is about 4.0–5.0.

17. The process of claim 16 wherein said solution comprises about 4–8% urea and about 20–40% precondensate, wherein said precondensate has a ratio range of tetrakis hydroxymethylphosphonium salt-to-urea of about 1.2:1 to 2.5:1; and further wherein said buffering agent is added after said solution's pH is adjusted to about 5.0–7.0.

18. A method of affixing a flame retardant polymer to a cellulosic fabric comprising contacting said fabric with an aqueous solution of urea and a precondensate consisting essentially of urea and a tetrakis hydroxymethylphosphonium salt, wherein said precondensate has a range of tetrakis hydroxymethyl-phosphonium salt-to-urea ratio of about 1.2:1 to 2.5:1; said solution is at a pH of about 5.0–7.0 and includes a buffering agent to neutralize acids formed during subsequent heat curing; and thereafter heat curing said fabric to render it flame retardant.

19. The process of claim 18 wherein said cellulosic fabric is cotton.

20. The process of claim 19 wherein said solution comprises about 4–8% urea and 20–40% precondensate.

* * * * *